US006619767B2

(12) United States Patent
Conway

(10) Patent No.: US 6,619,767 B2
(45) Date of Patent: Sep. 16, 2003

(54) DISPLAY WITH PIVOTAL DOORS HAVING MATING DOOR SECTIONS

(75) Inventor: Thomas M. Conway, Park Ridge, IL (US)

(73) Assignee: Cormark, inc., Des Plaines, IL (US)

( * ) Notice: Subject to any disclaimer, the term of this patent is extended or adjusted under 35 U.S.C. 154(b) by 0 days.

(21) Appl. No.: 09/813,172

(22) Filed: Mar. 20, 2001

(65) Prior Publication Data

US 2002/0134030 A1 Sep. 26, 2002

(51) Int. Cl.[7] ..... A47B 81/00
(52) U.S. Cl. ..... 312/234; 312/305
(58) Field of Search ..... 40/781, 780, 654.01, 40/775, 391; 27/27; 312/234, 114, 135, 234.5, 305, 326, 329, 257.1, 263, 265.5; 211/41.16, 41.15, 169

(56) References Cited

U.S. PATENT DOCUMENTS 569,367 A * 10/1896 Wood ..... 211/169
978,995 A * 12/1910 Ellis ..... 211/169.1
1,637,535 A * 8/1927 Rand ..... 283/36
1,948,738 A * 2/1934 Thayer ..... 211/11
3,408,128 A * 10/1968 Kump ..... 211/184
3,732,633 A * 5/1973 Margolis et al. ..... 211/162
3,921,322 A * 11/1975 Sharp ..... 40/405
5,740,910 A * 4/1998 Ueng ..... 206/373
6,102,502 A * 8/2000 Melillo et al. ..... 211/41.16

* cited by examiner

*Primary Examiner*—Janet M. Wilkens
(74) *Attorney, Agent, or Firm*—Welsch & Katz. Ltd.

(57) ABSTRACT

A display having mating door sections includes a frame, upper and lower parallel, spaced apart door mounts affixed to the frame, and doors mounted to the frame between the door mounts for securing panels thereto. The door mounts each include openings in vertical alignment with one another for mounting the doors. Each door is mounted to the display frame, between the upper and lower door mounts. Each door has first and second mating door sections joined to one another at a mating juncture. The mating door sections each have a raised rim around a rear portion and upper and lower edges of the sections defining a central recessed region. The recessed region has a plurality of apertures therein, each defining a raised sleeve portion and an opening therein. Each door includes upper and lower pivot pins at about the rear portion at the upper and lower rims respectively. The pivot pins extend transversely from the upper and lower rims and are configured for insertion into the door mount openings for pivotal movement of the doors. The doors are removable from between the upper and lower door mounts. The door sections recessed regions are each configured for mounting an associated panel thereto. Each associated panel resides within the recessed region below the door section raised rims.

12 Claims, 3 Drawing Sheets

DISPLAY WITH PIVOTAL DOORS HAVING MATING DOOR SECTIONS

BACKGROUND OF THE INVENTION

This invention pertains to a display having pivoting doors for mounting products thereto. More particularly, the present invention pertains to a display having pivoting doors formed from mating door sections in which the product mounting hardware is hidden from view.

A myriad of product displays are known in the art. Some of these displays are used for exhibiting large or relatively large products that can be used with a wide variety of hardware. One such example is a display for exhibiting cabinetry panels (e.g., kitchen and bath cabinet panels) and the hinge and pull hardware for these cabinets.

Typically, cabinet panels are hung on a display in a static or fixed manner. That is, the panels are merely hung from a display wall for an individual to view. The hardware for these cabinets, such as cabinet pulls and hinges (that may be visible) are likewise mounted to the display or can be shown on product cards.

Many such cabinetry exhibits are large free-standing exhibits in which the cabinets are shown in, for example, a model kitchen. In order to show the wide variety of cabinetry styles that may be available, either the various cabinets are mixed within one model kitchen or multiple model kitchens are displayed. While this may have the desired effect of exhibiting all of the available cabinetry styles, it can be visibly unappealing if all of the various cabinet styles are shown in one model kitchen. Conversely, an inordinately large space may be required if all of the various cabinetry styles are displayed in their own model kitchens.

In those instances where the various cabinetry panel styles are affixed to a single large display, it may be difficult for a viewer to move among the various cabinetry styles in order to select the one or most desirable cabinet. In addition, where the cabinetry panels are so exhibited, the cabinetry panels may be affixed to the display by, for example, wood screws or the like that are driven through the cabinetry panel and visible from the outside. While this may be effective in mounting the panel, the mounting hardware can visually detract from the panel and may not allow the viewer to fully appreciate the beauty of the representative panel.

Accordingly, there exists a need for a display suitable for mounting relatively large cabinetry panels thereto. Desirably, such a display is relatively compact, and includes pivotal doors having mating door sections on which the cabinetry panels are readily mounted to either side, i.e., front and rear, of the door section. Most desirably, such a door can accommodate the cabinetry hardware, such as hinges (if visible) and door pulls when viewing the cabinetry panels. Such a display permits mounting the cabinetry panels and hardware in a manner that the fasteners mounting the panels and hardware (e.g., hinges and pulls) to the display are not visible to the viewer.

BRIEF SUMMARY OF THE INVENTION

A display having mating door sections includes a frame, upper and lower parallel, spaced apart door mounts affixed to the frame, and doors mounted to the frame between the door mounts. The display is relatively compact and is suitable for mounting relatively large cabinetry panels thereto.

The doors are pivotally mounted to the frame. The panels are mounted to the doors. Preferably, the doors can accommodate cabinetry hardware, such as hinges (if visible) and door pulls when viewing the cabinetry panels. The cabinetry panels and hardware are mounted in a manner so that the fasteners mounting the panels and hardware (e.g., hinges and pulls) to the display are not visible to the viewer.

To this end, the door mounts each including openings therein in vertical alignment with one another for mounting the doors to the frame. The door is mounted to the display, between the upper and lower door mounts for pivotal movement.

The door is formed from mating door sections joined to one another at a mating juncture. The mating door sections each have a raised rim around a rear portion and upper and lower edges of the sections that define a central recessed region. The recessed region has a plurality of apertures therein, each defining a raised sleeve portion for fastening the cabinetry panels to the door sections.

Each door includes upper and lower pivot pins at about the rear portion at the upper and lower rims respectively. The pivot pins extend transversely from the upper and lower rims and are configured for insertion into the door mount openings for pivotal movement of the door. The door is removable from between the upper and lower door mounts.

In a preferred embodiment, the display includes a locking bar mounted to the upper mount. The locking bar retains the door between the upper and lower mounts, and prevents inadvertently removing or knocking the door from the frame.

The doors can include a collar disposed about the lower pivot pin, adjacent the door lower rim. The collar is a saloon door hinge having substantially symmetrical, inclined, opposed surfaces. The hinge is configured for engagement with the lower door mount to bias the door to a predetermined position. Preferably, each door is biased to substantially the same predetermined position.

In one embodiment that provides for readily installing and removing the doors and for locking the doors to the frame, each door has a height defined by a distance between the upper and lower rims at the rear portion of the door section and the upper and lower door mounts define a distance between one another. The distance between the mounts is greater than the door height. The difference between the door height and the distance between the mounts is defined as a clearance. The upper pin has a length that is greater than the clearance and the lower pin has a length that is less than the clearance. In this configuration, the doors are readily installed into and removed from the frame.

The locking bar is mounted to the upper mount to retain the door between the upper and lower mounts. The locking bar can be configured with a depending lip that has a length that is less than the clearance and greater than the lower pin length.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
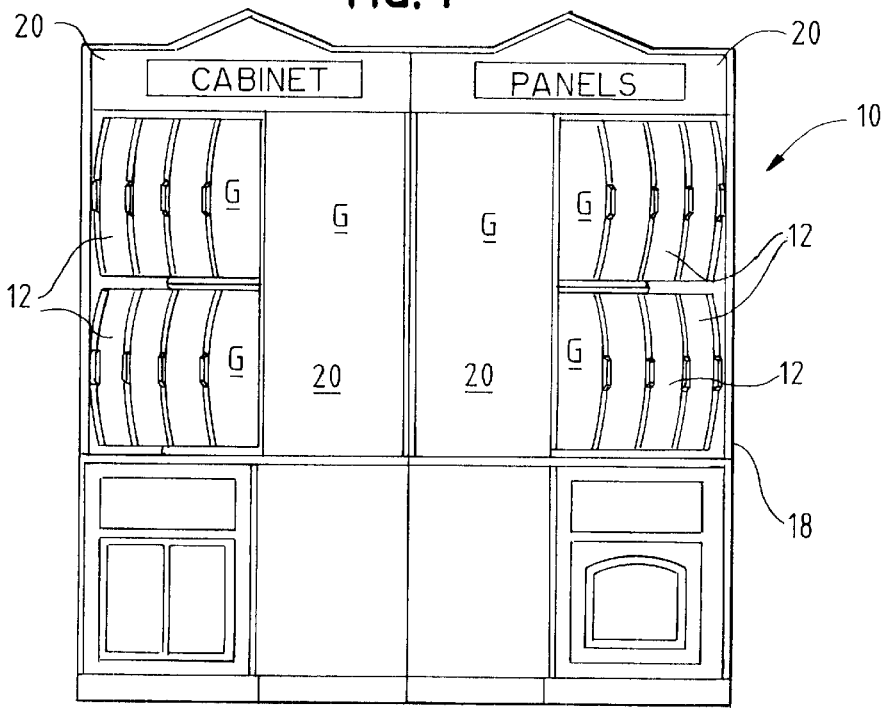
FIG. 1 is a front view of an exemplary cabinetry display that includes multiple cabinet panel display doors pivotally mounted thereto.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1 there is shown an exemplary cabinetry panel display 10 embodying the principles of the present invention. The exemplary display 10 includes multiple pivoting doors 12 having mating door sections 14, 16 as will be described in more detail below. The display 10 includes a frame 18 and a plurality of panels 20 to, for example, mount graphics G that are provided for aesthetic appeal. In the illustrated display 10, the cabinetry display doors 12 are mounted in two horizontal rows in the display 10 and four doors 12 are mounted in each of the display half horizontal rows.

Figure 2:
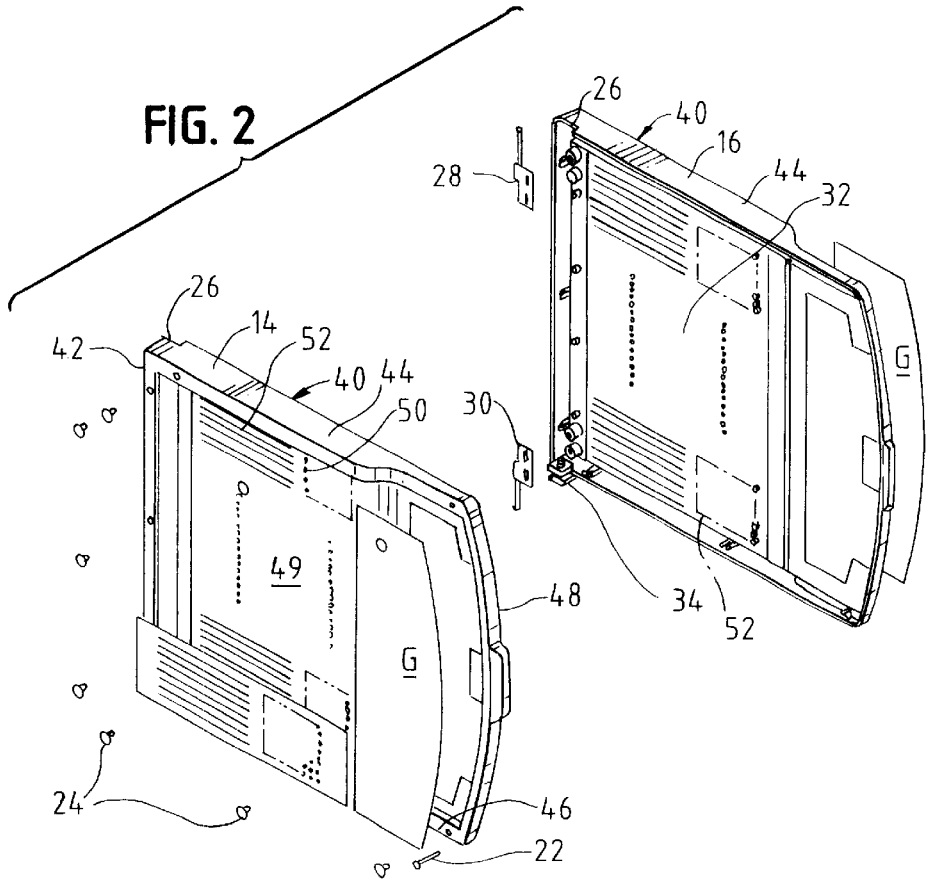
FIG. 2 is an exploded view of a door in accordance with the principles of the present invention.

Referring now to FIG. 2, each door 12 includes first and second molded, mating sections or halves 14, 16 that mount to one another by standard hardware, such as threaded fasteners 22 and the like. The sections 14, 16 are substantially mirror images of one another. The hardware 22 is hidden from view by caps 24 that insert over the hardware 22. Each of the door sections 14, 16 includes recesses or cut-outs 26 to accommodate upper and lower pivot pins 28, 30, respectively. The pins 28, 30 mount to the door sections 14, 16 at an interior region 32 of the door 12 so that the pivot pins 28, 30 remain essentially unseen from the outside of the display, by a viewer.

Figure 6:
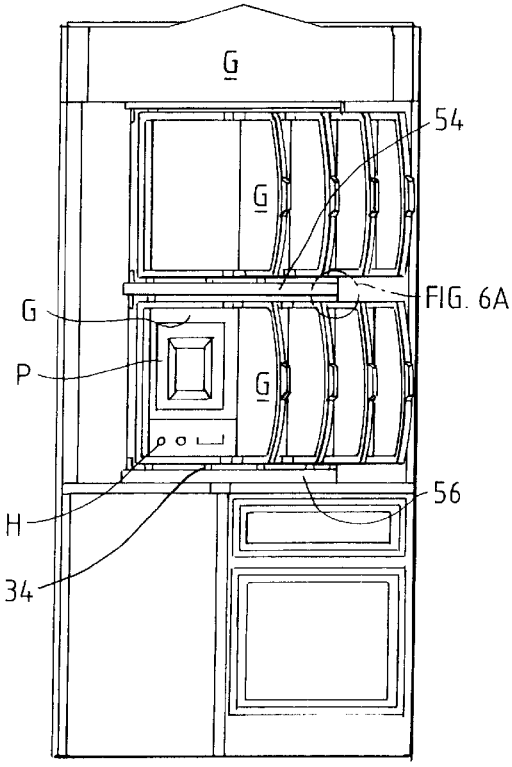
FIG. 6 illustrates the half display of FIG. 5 and showing the upper door locking member in place and in an exploded view.
Figure 6A:
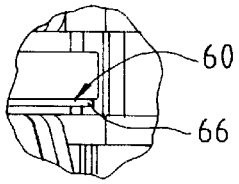
FIG. 6A illustrates the lip of the locking bar in position.
Figure 7:
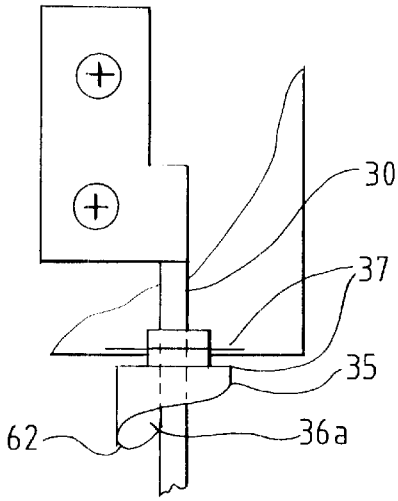
FIG. 7 is a side view of the lower pivot pin and saloon door hinge mounted thereon, the pin being viewed from the inside of the door and illustrating the mount for the pin.
Figure 8:
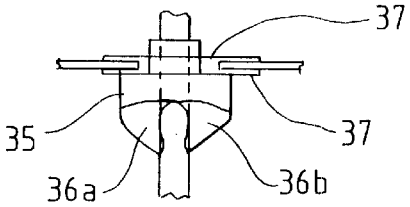
FIG. 8 is a front view of the pin and hinge of FIG. 8.

The lower pin 30 has a saloon door type sleeve hinge 34 mounted to the pin 30. The saloon door hinge 34 is formed from an outer collar 35 that fits over the pin 30. Referring to FIGS. 7–8, the sleeve 35 has first and second substantially symmetrical, opposed inclined surfaces 36*a,b* so that the door 12 will pivot by gravity, to the display orientation as shown in FIGS. 1 and 6, that is with the doors 12 oriented outwardly. The saloon door hinge 34 fits into a preformed notch 38 in each of the door sections 14, 16 to provide a mount the hinge 34 to the door 12. The hinge 34 includes flanges 37 that sandwich the door lower rim 46 for securing to the door 12. When the sections 14, 16 are mounted to one another, the pins 28, 30 and hinge 34 are secured between the sections 14, 16 to assure that they remain in place.

Figure 3:
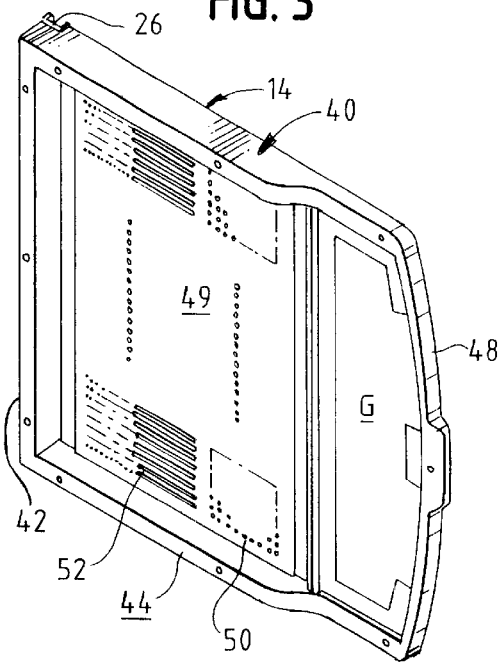
FIG. 3 is a perspective view of one of the exemplary door sections as seen from the viewing side, i.e., front side of the door section.

Referring now to FIG. 3, each of the door sections 14, 16 has a wide, outer rim, indicated generally at 40, extending around the rear 42 and upper and lower portions 44, 46 of the door section 14, 16. A front door region 48 can include a lesser rim height. The rim height increases at the rear 42 and upper and lower portions 44, 46 of each door section 14, 16 to accommodate a cabinetry panel P for display (see FIG. 5). Each door section 14, 16 thus defines a recessed region 49 bounded by the increased rear 42, upper and lower 44, 46 rim heights. In this manner, when the cabinetry panel P is mounted to the door section 14, 16, it can be fully recessed within these heightened door section rims 42, 44, 46.

Figure 4:
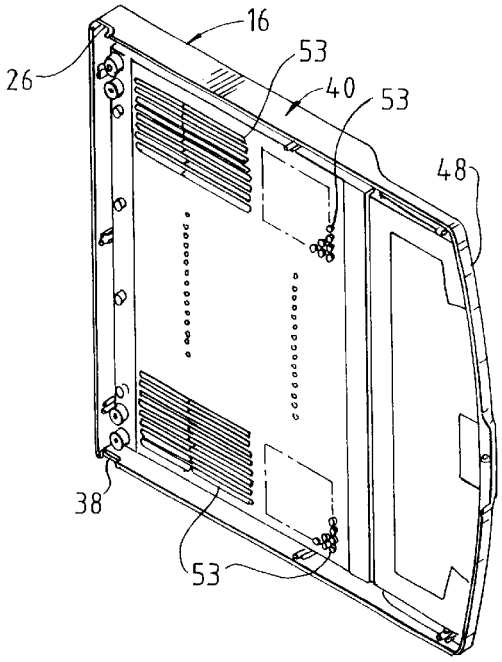
FIG. 4 is a perspective view of the door section as seen from the interior or rear side of the door section.

As seen in FIGS. 3 and 4, each door section 14, 16 includes a plurality of mounting holes 50 and notches 52. All of these mounting apertures (the holes 50 and notches 52 are referred to collectively as apertures), are formed in of each of the door sections 14, 16 and include integral, inwardly extending sleeves 53. The sleeves 53 provide an increased depth or thickness around the apertures 50, 52, thus increasing the amount of material around the apertures 50, 52 to increase the structural integrity of the door section 14, 16, and in particular the region 49 at which cabinetry panels P are mounted to the sections 14, 16. In that it is anticipated that the door sections 14, 16 will be manufactured (e.g., molded) from a polymeric material (such as polystyrene and the like) the increased structural integrity around the apertures 50, 52 permits securely mounting the cabinetry panels P thereto. The door sections 14, 16 can accommodate mounting hardware H and the like, such as drawer pulls and hinges adjacent, such as below each of the cabinetry panels P. The plurality of mounting apertures 50, 52 permits positioning this hardware H in a desired, aesthetically appealing manner around the panels P.

Graphics G can be positioned on each of the door sections 14, 16 (as well as on panels 20) to provide aesthetically appealing backdrops for the cabinetry panels P and hardware H. The graphics G can be readily removed and reapplied on any of the door sections 14, 16 as desired so that a desired aesthetic can be achieved.

The doors 12 are mounted to the display 10 at upper and lower mounting bars 54, 56. Each of the mounting bars 54, 56 includes a plurality of openings 58 (see FIG. 9) formed therein that are configured to receive the pivot pins 28, 30. In that the doors 12 can be quite heavy when cabinetry panels P are mounted thereto, it is most desirable to mount the doors 12 to the display 10 so that they are retained in the display 10 and are not inadvertently removed or knocked from the display 10.

Figure 9:
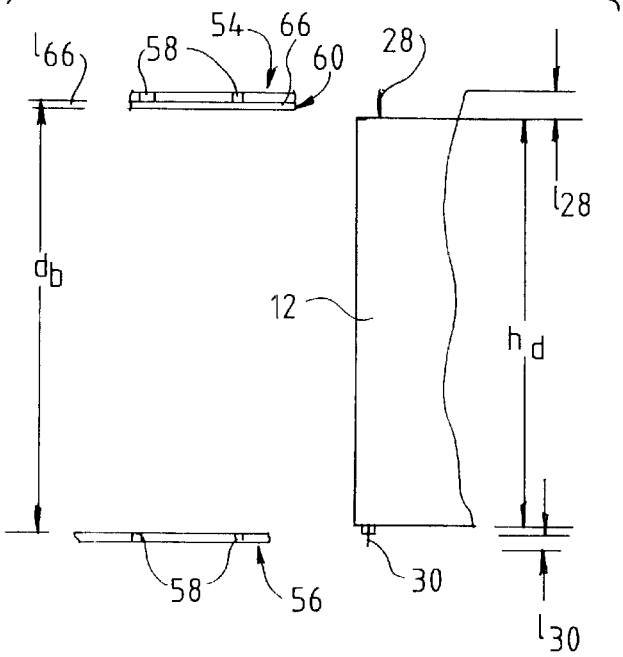
FIG. 9 illustrates the relationship between the door height, the spacing between the upper and lower door mounts and the lengths of the upper and lower pivot pins.

To this end, a locking bar 60 is mounted to the upper mounting bar 54 to prevent inadvertently removing the doors 12 from the display 10. It will be appreciated from a study of the figures that it is relatively straight forward to install and remove the doors 12 from the display 10. Referring to FIG. 9, the door 12 has a height $h_d$, measured between the upper and lower rims 44, 46 at the rear portion 42 of the door 12. The distance $d_b$ between the upper and lower mounting bars 54, 56 is greater than the door height hd, which difference in heights is defined as a clearance C. The upper pivot pin 28 has a length $l_{28}$ that is greater than the clearance C and the lower pivot pin 30 has a length $l_{30}$ that is less than the clearance C. When the saloon door hinge 34 is used, the length $l_{30}$ of the lower pivot pin 30 is measured from a nadir 62 of the hinge 34.

To this end, the upper pivot pin 28 is inserted into an opening 58 in the upper mounting bar 54 until the door upper rim 44 contacts the upper bar 54. At this point, there is sufficient clearance to position the lower pin 30 above the corresponding opening 58 in the lower bar 56 and simply guide the lower pin 30 into place in the lower bar opening 58. In that it is also relatively straight forward to remove the door 12 (merely by urging the door 12 upwards so that the door 12 contacts the upper mounting bar 54, which clears the lower pin 30 from the lower mounting bar 56), it is desirable to lock the door 12 in place on the display 10. The locking bar 60 provides such a locking arrangement.

Figure 5:
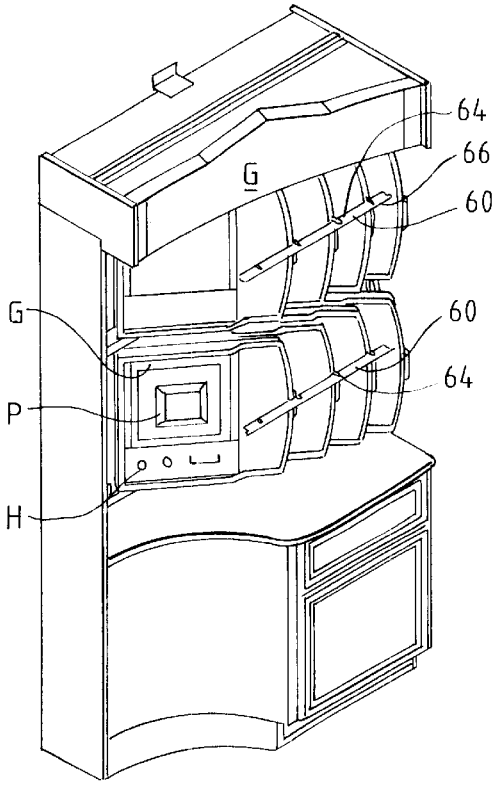
FIG. 5 is a perspective view of one-half of the display illustrating the door locking members in an exploded perspective.

The locking bar 60 is an elongated bar that mounts to the upper mounting bar 54. Referring to FIG. 5, the locking bar 60 includes a plurality of notches 64, each notch 64 corresponding to and cooperating with an upper pivot pin 28. The locking bar 60 fits around the pins 28 and mounts to the upper mounting bar 54. The locking bar 60 has a depending lip 66 that prevents upwardly urging the door 12 to free the lower pivot pin 30 from the lower mounting bar 56. The lip 66 has a depending length $l_{66}$(or height) that is less than the clearance C (the difference between the door height $h_d$ and the upper and lower mounting bar distance $d_b$), but is greater than the length $l_{30}$ of the lower pin 30. As such, when the door 12 is urged upwardly so that it contacts the upper mounting bar 54, there is insufficient clearance between the lower pivot pin 30 and the lower mounting bar 56 to remove the pin 30 from the bar 56. Thus, the doors 12 are "locked" into the display 10. Nevertheless, the doors 12 are readily removed from the display 10 for reconfiguring or for mounting new cabinetry panels P to the doors 12, by simply removing the locking bar 60 and removing the doors 12.

In a current embodiment, the locking bar 60 is mounted to the upper mounting bar 54 by a plurality of fasteners, such as threaded screws or the like. Other fastening arrangements will be recognized and appreciated by those skilled in the art.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A display, comprising:

a frame;

upper and lower parallel, spaced apart door mounts affixed to the frame, the door mounts each including an opening therein, the openings being in vertical alignment with one another; and a door, mounted to the display, between the upper and lower door mounts, the door having first and second mating door sections joined to one another at a mating juncture, the mating door sections each having a raised rim around a rear portion and upper and lower edges of the sections defining a central recessed region, the recessed region having a plurality of apertures therein, each defining a raised sleeve portion, each door including upper and lower pivot pins at about the rear portion at the upper and lower rims respectively, the pivot pins extending transversely from the upper and lower rims and configured for insertion into the door mount openings for pivotal movement of the door, the door being removable from between the upper and lower door mounts, wherein the door section recessed regions are each configured for mounting an associated panel thereto, each associated panel residing within the recessed region below the door section raised rims.

2. The display in accordance with claim 1 including a locking bar mounted to the upper mount to retain the door between the upper and lower mounts.

3. The display in accordance with claim 1 including a collar disposed about the lower pivot pin, adjacent the door lower rim, the collar having substantially symmetrical, inclined, opposed surfaces and configured for engagement with the lower door mount to bias the door to a predetermined position.

4. The display in accordance with claim 3 including a plurality of doors, each door biased to substantially the same predetermined position.

5. The display in accordance with claim 1 wherein the door has a height defined by a distance between the upper and lower rims at the rear portion of the door section and wherein the upper and lower door mounts define a distance therebetween that is greater than the door height defining a clearance, and wherein the upper pin has a length greater than the clearance and the lower pin has a length less than the clearance.

6. The display in accordance with claim 5 including a locking bar mounted to the upper mount to retain the door between the upper and lower mounts, the locking bar having a depending lip, the lip having a length less than the clearance and greater than the lower pin length.

7. The display in accordance with claim 1 wherein the associated panels are mounted by fasteners attached from between the door sections.

8. A multiple panel display for displaying multiple associated panels mounted to doors, the associated panels being removable from the doors, the display having an upright portion, comprising:

a frame including upper and lower parallel, spaced apart door mounts affixed to the frame, the door mounts each including openings therein, the openings in the upper and lower mounts being in vertical alignment with one another;

a plurality of substantially identical doors mounted to the display between the upper and lower door mounts, each door having first and second mating door sections joined to one another at a mating juncture, each door section defining in interior surface and an exterior surface, the interior surfaces being in face-to-face relation to one another when the door sections are joined, the exterior surface being in face-to-face relation to an exterior surface of an adjacent door surface, each door section defining a central, recessed panel mounting region having a plurality of apertures formed therein defined by a raised sleeve portion and a central opening, each door including a plurality of hardware mounting openings therein proximal the panel mounting region, each door including upper and lower pivot pins at about a rear portion at upper and lower raised rims respectively, the pivot pins extending transversely from upper and lower edges of the door and configured for insertion into the door mount openings for pivotal movement of the door, the door being removable from between the upper and lower door mounts; and a locking bar mounted to the upper mount to retain the doors between the upper and lower mounts, wherein each door section recessed panel mounting region is configured for mounting the associated panel thereto, each associated panel residing within the recessed region below the door section raised rims.

9. The multiple panel display in accordance with claim 8 wherein each door lower pivot pin includes a collar disposed thereabout, adjacent the door lower edge, the collar having substantially symmetrical, inclined, opposed surfaces and configured for engagement with the lower door mount to bias each door to a predetermined position.

10. The display in accordance with claim 9 wherein each door is biased to substantially the same predetermined position.

11. The display in accordance with claim 8 wherein each door has a height defined by a distance between the upper and lower edges at about the upper and lower pivot pins and wherein the upper and lower door mounts define a distance therebetween that is greater than the door height and defines a clearance, and wherein the upper pin has a length greater than the clearance and the lower pin has a length less than the clearance.

12. The display in accordance with claim 11 wherein the locking bar has a depending lip having a length less than the clearance and greater than the lower pin length.

* * * * *